US008783844B2

(12) United States Patent
Ohta

(10) Patent No.: US 8,783,844 B2
(45) Date of Patent: Jul. 22, 2014

(54) INK JET RECORDING METHOD, INK JET RECORDING APPARATUS, AND RECORDING MATERIAL

(71) Applicant: Seiko Epson Corporation, Tokyo (JP)

(72) Inventor: Hitoshi Ohta, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/744,545

(22) Filed: Jan. 18, 2013

(65) Prior Publication Data

US 2013/0202861 A1 Aug. 8, 2013

(30) Foreign Application Priority Data

Jan. 19, 2012 (JP) ..... 2012-009381

(51) Int. Cl.
*B41J 2/01* (2006.01)
*B41J 2/21* (2006.01)

(52) U.S. Cl.
CPC . *B41J 2/01* (2013.01); *B41J 2/2107* (2013.01)
USPC ..... 347/100; 347/96; 347/101

(58) Field of Classification Search
CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101
USPC ..... 347/100, 105, 95, 96, 103, 102, 20, 21, 347/9; 106/31.6, 31.13, 31.27; 523/160, 523/161; 428/195, 32.1
See application file for complete search history.

(56) References Cited

U.S. PATENT DOCUMENTS

| | | | | |
|---|---|---|---|---|
| 2004/0046849 | A1* | 3/2004 | Onishi | 347/101 |
| 2004/0201658 | A1* | 10/2004 | Jackson et al. | 347/100 |
| 2006/0023044 | A1* | 2/2006 | Bauer | 347/100 |
| 2006/0092251 | A1* | 5/2006 | Prasad et al. | 347/100 |
| 2007/0229636 | A1* | 10/2007 | Mubarekyan et al. | 347/100 |
| 2008/0257203 | A1* | 10/2008 | Choy et al. | 106/31.13 |
| 2009/0295893 | A1* | 12/2009 | Akiyama et al. | 347/96 |
| 2010/0118095 | A1 | 5/2010 | Nakamura | |
| 2011/0234682 | A1* | 9/2011 | Ohta et al. | 347/20 |
| 2012/0176455 | A1* | 7/2012 | Ohta et al. | 347/102 |

FOREIGN PATENT DOCUMENTS

JP 2010-115791 A 5/2010

* cited by examiner

*Primary Examiner* — Manish S Shah
(74) *Attorney, Agent, or Firm* — Nutter McClennen & Fish LLP

(57) ABSTRACT

An ink jet recording method includes recording an image on a target recording face including polyolefin by ejecting an ink composition containing water, a coloring material, and resin from nozzles of an ink jet recording head, in which two or more of the following are satisfied. Condition (A): Prior to the recording, there is included performing a hydrophilic treatment on the target recording face, Condition (B): The ink composition includes glycol ethers of which the HLB value calculated by the Davis method is 4.2 or more to 9.0 or less, and Condition (C): After the recording, there is included coating the image with a coating liquid composition containing wax.

8 Claims, 1 Drawing Sheet

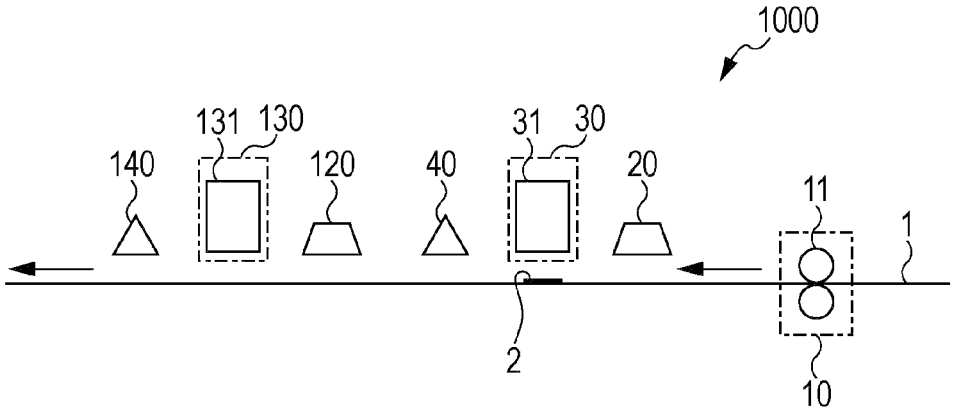
1000
131
130
31
30
140
120
40
20
11
1
2
10

INK JET RECORDING METHOD, INK JET RECORDING APPARATUS, AND RECORDING MATERIAL

Priority is claimed under 35 U.S.C. §119 to Japanese Application No. 2012-009381 filed on Jan. 19, 2012, is hereby incorporated by reference in its entirety.

BACKGROUND

1. Technical Field

The present invention relates to an ink jet recording method, an ink jet recording apparatus and a recording material.

2. Related Art

In the related art, the recording of images and characters using minute ink droplets ejected from nozzles of an ink jet recording head, that is, an ink jet recording method is known. This ink jet recording method has been investigated with the object of being used in various fields in recent years for the reasons that the miniaturization of an apparatus is easy in comparison with the recording methods of the related art, the noise during recording is comparatively low, and the ink consumption amount is comparatively low since the ink is only used in a range which is necessary during recording. Therefore, there is a demand to be able to record an image with a favorable fixing property and quality with respect to not only a recording medium with high ink absorption (for example, normal paper, ink jet paper, or the like), but also to a recording medium with low or no ink absorption (for example, a polyolefin based plastic film such as polyethylene or the like). For example, in JP-A-2010-115791, there is described the recording of an image on a recording medium such as a polyolefin based plastic film using photocurable ink containing a coloring material, a photocurable monomer, a photopolymerization initiator, a gelling agent, and the like.

However, the photocurable ink as described above requires a mechanism for irradiating light to cure the ink attached to the recording medium. Therefore, there have been problems such as increases in the size of the ink jet recording apparatus, increases in the consumption of electric power, and the like. In addition, since the photocurable ink uses a large amount of organic solvent as the main solvent, there have been cases of problems relating to the environmental impact or the like which required special exhaust equipment.

Therefore, from the viewpoints of ease of handling, reducing the environmental impact, and the like, water-based inks have been widely investigated and used as inks used in the ink jet recording method. Water-based inks are ones in which coloring agents such as various types of dyes, pigments, or the like are dissolved or dispersed in a mixture of an organic solvent and water. However, the water-based inks that have been investigated in the related art are capable of favorably recording on a PET film or the like, but have difficulty in sufficiently fixing an image when recorded onto the polyolefin based plastic film, or the like. In addition, since the wetting and spreading properties on the polyolefin based plastic film are not sufficient, a phenomenon, in which ink is greatly unevenly distributed to and remains in a portion of the desired image region, that is, shading unevenness, occurs, whereby a tendency for the quality of the image to deteriorate is seen. This phenomenon has a tendency to be easily generated particularly in image portions in which the amount of attached ink is great in filled image portions or the like. The reasons for such a phenomenon occurring include the point that, in the polyolefin based plastic film, cases where the deformation temperature is lower than the PET film or the like are common, and for this reason it is difficult to perform heating sufficiently to dry and bond the ink on the film, and the further point that the polyolefin based plastic film tends to have surface hydrophobicity stronger in comparison with the PET film or the like, whereby the compatibility with water-based inks of the related art is poor, wetting and spreading are difficult, and adhesion is difficult.

SUMMARY

An advantage of some aspects of the invention is that it provides an ink jet recording method capable of recording an image having an excellent fixing properties and image quality with respect to a recording medium (below, this recording medium is described as a "target recording face including polyolefin") of which a target recording face is configured by a polyolefin based plastic film.

The invention can be realized in the following forms or application examples.

APPLICATION EXAMPLE 1

According to Application Example 1, there is provided an ink jet recording method including: recording an image on a target recording face including polyolefin by ejecting an ink composition containing water, a coloring agent, and resin from nozzles of an ink jet recording head, in which two or more of the following condition (A), condition (B), and condition (C) are satisfied.

Condition (A): Prior to the recording, there is included performing a hydrophilic treatment on the target recording face Condition (B): The ink composition includes glycol ethers of which an HLB value calculated by the Davis method is 4.2 or more to 9.0 or less Condition (C): After the recording, there is included coating the image with a coating liquid composition containing wax According to the ink jet recording method of Application Example 1, it is possible to record an image with an excellent fixing property and image quality with respect to the target recording face including polyolefin. Here, the "image" in the invention indicates a printed pattern formed from a group of dots, including text printing and solid printing.

APPLICATION EXAMPLE 2

In Application Example 1, the ink method may further include performing a hydrophilic treatment on the image before the coating in the condition (C).

APPLICATION EXAMPLE 3

In Application Example 1 or Application Example 2, the resin may be at least one type or more selected from (a) a resin including a (meth)acrylic acid based copolymer, (b) a resin including a copolymer of an olefin based monomer and a monomer having an aprotic polar group, (c) a resin including a copolymer of an olefin based monomer and a monomer containing halogen, and (d) a resin including a polycondensate of polycarboxylic acids and polyhydric alcohols.

APPLICATION EXAMPLE 4

In one example of any one of Application Example 1 to Application Example 3, the wax in condition (C) may be a paraffin wax or a polyolefin wax.

APPLICATION EXAMPLE 5

In one example of any one of Application Example 1 to Application Example 4, the coating liquid composition in condition (C) may contain glycol ethers of which the HLB value calculated by the Davis method is 4.2 or more to 9.0 or less.

APPLICATION EXAMPLE 6

In one example of any one of Application Example 1 to Application Example 5, an alkyl group of the glycol ethers in the condition (B) may have a branched structure.

APPLICATION EXAMPLE 7

An ink jet recording apparatus according to Application Example 7 uses the ink jet recording method according to any one example of Application Example 1 to Application Example 6.

APPLICATION EXAMPLE 8

A recording material according to the Application Example 8 is one in which an image is formed according to the ink jet recording method according to any one example of Application Example 1 to Application Example 6.

BRIEF DESCRIPTION OF THE DRAWING

The invention will be described with reference to the accompanying drawing, wherein like numbers reference like elements.

FIG. 1 is a schematic diagram of an example of an ink jet recording apparatus using the ink jet recording method according to the present embodiment.

DESCRIPTION OF EXEMPLARY EMBODIMENTS

Below, description will be given of favorable embodiments of the invention. The embodiment described below describes one example of the invention. In addition, the invention is not limited by the below embodiments and includes various types of modifications carried out in a range not departing from the gist of the invention.

1. Ink Jet Recording Method

The ink jet recording method according to an embodiment of the invention includes recording an image on a target recording face including polyolefin by ejecting an ink composition containing water, a coloring agent, and resin from nozzles of an ink jet recording head, in which two or more of the following condition (A), condition (B), and condition (C) are satisfied.

Condition (A): Prior to the recording, there is included performing a hydrophilic treatment on the target recording face Condition (B): The ink composition includes glycol ethers of which the HLB value calculated by the Davis method is 4.2 or more to 9.0 or less Condition (C): After the recording, there is included coating the image with a coating liquid composition containing wax As will be described later, the above-described condition (A) to (C) are all means for improving the fixing property of an image or the image quality with respect to a target recording face including polyolefin. By implementing a combination of two or more of the above-described conditions (A) to (C) and using the synergistic effect thereof, the ink jet recording method according to the embodiment is capable of remarkably improving the fixing property of an image or the image quality with respect to a target recording face including polyolefin.

Here, the combination of two or more of conditions (A) to (C) refers to, specifically, a combination of condition (A) and condition (B), a combination of condition (A) and condition (C), a combination of condition (B) and condition (C), or a combination of condition (A), condition (B), and condition (C).

Below, detailed description will be given of each step in the ink jet recording method according to the embodiment.

1.1. Recording Step

The ink jet recording method according to the embodiment includes recording an image on a target recording face including polyolefin by ejecting an ink composition (described later) from nozzles of an ink jet recording head. In this manner, a recording material on which an image formed of an ink composition on the target recording face of the recording medium is recorded is obtained.

As long as the recording medium used in the ink jet recording method according to the embodiment is provided with a target recording face including polyolefin, there is no particular limitation. Examples of the polyolefins specifically include polyethylene, polypropylene, or the like.

As will be described later, the ink composition may at least contain water, a coloring material, and resin; however, in order to further improve the fixing property to the target recording face including polyolefin and image quality, glycol ethers (described below) of which the HLB value calculated by the Davis method is 4.2 or more to 9.0 or less may be included (condition B).

1.2. First Treatment Step

The ink jet recording method according to the embodiment may include, prior to the recording, a first treatment step of performing a hydrophilic treatment on the target recording face (condition A). According to the first treatment step, a polar group having high hydrophilicity (for example, a hydroxyl group, a carboxyl group, or the like) is introduced into the target recording face including polyolefin provided with a hydrophobic nature. In this manner, the ink composition with water as the main solvent is easily fixed to the target recording face and the wetting and spreading becomes easy.

The hydrophilic treatment in the first treatment step may be performed at least in a region where the image is formed in the target recording face, or may be performed on the entire face of the target recording face. When the hydrophilic treatment is performed on the entire face of the target recording face, in the coating to be described later, it is possible to improve the fixing property and the wetting and spreading property of the coating liquid composition in a case where the coating liquid composition is attached to a region other than where the image is recorded.

The hydrophilic treatment in the first treatment step can be performed using a method of hydrophilizing the target recording face by introducing a polar group (for example, a hydroxyl group, a carboxyl group, or the like) with high hydrophilicity into the target recording face including polyolefin using a known corona discharge treatment apparatus, or a method of hydrophilizing the target recording face using a plasma discharge treatment apparatus.

1.3. Coating Step

The ink jet recording method according to the embodiment may include, after the recording, coating the image with a coating liquid composition (described later) containing wax (condition (C)). By this step, the coating liquid composition forms a coating film covering the image. The coating film formed of the coating liquid composition is capable of improving the fixing property of the image with respect to the target recording face since the generation of peeling and rubbing of the image can be suppressed by covering the image.

The coating film forming the coating liquid composition should cover at least the upper surface of the image; however, for example, the coating film may cover from the upper surface to the side surface of the image in a continuous manner, and further cover up to the target recording face where the image is not recorded in a continuous manner. In this manner, when the coating film formed of the coating liquid composition forms a coating film continuously covering the upper surface and the side surface of the image and the target recording face where the image is not recorded, the fixing property of the coating film formed of the coating liquid composition is further improved. In this manner, since the fixing property of the image is further increased, this is preferable.

1.4. Second Treatment Step

The ink jet recording method according to the embodiment may further include, prior to the coating in the condition (C), a second treatment step of performing a hydrophilic treatment on the image. In this manner, since the polar group with high hydrophilicity can be introduced into the surface of the image, the coating liquid composition is easily fixed to the surface of the image and the wetting and spreading becomes easy. Similarly to the above-described first treatment step, the second treatment step can be performed using a known corona discharge treatment apparatus or a plasma discharge treatment apparatus.

The hydrophilic treatment in the second treatment step may be performed with respect to the image formed on at least the target recording face, or may be performed in a region other than the region where the image is recorded. In a case where the coating liquid composition is attached to both sides of the image and a region other than the region where the image is recorded, when the hydrophilic treatment is performed in the region other than the region where the image is recorded, it is possible to further improve the fixing property and the wetting and spreading of the coating liquid composition.

1.5. Drying

The ink jet recording method according to the embodiment may further include, in addition to the above-described steps, drying the image during the recording or after the recording. By incorporating the drying, a liquid medium (specifically, components such as water, a solvent, or the like) contained in the ink composition attached to the target recording face is quickly evaporated and dispersed, whereby it is possible to quickly form a coated film of the resin included in the ink composition. In this manner, even on a target recording face including polyolefin which does not have an ink absorbing layer, it is possible to obtain an image with little shading unevenness and a high image quality in a short time. In addition, by quickly forming the coated film of the resin used in the ink composition, dry matter of the ink composition is favorably adhered to the recording medium and the fixing property of the image is improved.

The temperature range when applying heat in the drying is not particularly restricted as long as it is possible for the evaporation and dispersion of the liquid medium present in the ink composition to proceed; however, in consideration of the heat characteristics of the polyolefin based film, the above effect is obtained at 40° C. or more to 90° C. or less, preferably 40° C. to 80° C., and more preferably in a range of 40° C. to 70° C. If the temperature is 90° C. or more, depending of the type of the recording medium, there are cases where defects such as deformation or the like are generated causing difficulties in the transporting of the recording medium after the drying, and where defects such as shrinkage are caused when cooling the recording medium to room temperature. Here, the temperature is the temperature of the recording medium surface (target recording face) in contact with the ink composition.

In a case where the coating in the above-described condition (C) is performed, the drying is during the recording or after the recording and preferably performed before the coating. In this manner, bleeding of the ink composition and the coating liquid composition does not easily occur and a favorable image is obtained.

In addition, the drying to be performed in a case where the coating process is performed in the above-described condition (C) is preferably performed until the weight of the ink composition attached to the target recording face is 30% or more to 80% or less with respect to the weight immediately after attachment. By the weight of the ink composition after drying being in the above-described range and not particularly exceeding the upper limit thereof, the fixing property of the image formed by the ink composition is favorable and the fixing property of the coating liquid composition with respect to the image is also improved. In addition, by the weight of the ink composition after drying being in the above-described range and not particularly exceeding the lower limit thereof, it is possible to further suppress the generation of bleeding.

The ink jet recording method according to the embodiment may further be provided with drying the coating liquid composition during the coating or after the coating and after the drying the image formed by the ink composition before the coating. In this manner, it is possible to further improve the fixing property of the coating liquid composition.

2. Recording Apparatus

Next, an example of an ink jet recording apparatus which can be favorably used in the above-mentioned ink jet recording method will be exemplified. Here, the ink jet recording apparatus which can be used in the ink jet recording method according to the invention is not limited to the following aspects.

FIG. 1 is a schematic diagram of an example of an ink jet recording apparatus using the ink jet recording method according to the embodiment.

An ink jet recording apparatus 1000 of the embodiment is provided with a transport means 10 for transporting a recording medium 1, a first hydrophilic treatment means 20 for performing a hydrophilic treatment, a first recording means 30 for recording an image using an ink composition, a first drying means 40 for drying the image, a second hydrophilic treatment means 120 for performing a hydrophilic treatment, a second recording means 130 for forming a coated film using a coating liquid composition, and a second drying means 140 for drying the coated film formed of the coating liquid composition. Here, in the embodiment, the hydrophilic treatment means 20 and 120 use corona discharge.

2.1. Transport Means

The transport means 10 can be configured, for example, using a roller 11. The transport means 10 may have a plurality of rollers 11. In the illustrated example, in the transport direction of the recording medium 1 (indicated by an arrow in the drawing), the transport means 10 is provided further to the upstream side than the first hydrophilic treatment means 20; however, without being limited thereto, the number and provided position are arbitrary as long as it is possible to transport the recording medium 1. The transport means 10 may be provided with a feeding roll, a feeding tray, a discharge roll, a discharge tray, various types of platen, and the like.

The recording medium 1 transported by the transport means 10 is transported to a position where a hydrophilic treatment is performed on the target recording face by the first hydrophilic treatment means 20.

Here, in FIG. 1, a case where the recording medium 1 is a continuous body is exemplified; however, even when the recording medium 1 is in cut-form, by appropriately configuring the transport means 10, it is possible to perform transport of the recording medium in the above-described manner.

2.2. First Hydrophilic Treatment Means

The first hydrophilic treatment means 20 can be configured using a known corona discharge treatment apparatus or a plasma discharge treatment apparatus. The hydrophilic treatment according to the first hydrophilic treatment means 20 is used in a case where the above-described first treatment step is performed. The ink jet recording apparatus 1000 according to the embodiment need not be provided with the first hydrophilic treatment means 20 in a case where the above-described first treatment step is not performed.

2.3. First Recording Means

The first recording means 30 records an image 2 using an ink composition with respect to the target recording face of the recording medium 1. The first recording means 30 is provided with an ink jet recording head 31 provided with a nozzle ejecting the ink composition.

Examples of the method of ejecting the ink composition from the nozzles of the ink jet recording head 31 include the following. Specifically, examples include a method applying a strong electric field between a nozzle and an accelerating electrode placed in front of the nozzle, continuously ejecting the ink composition in droplet form from the nozzle, and performing recording by applying a recording information signal to a bias electrode while the droplets of the ink composition are flying between bias electrodes, or a method performing ejection according to the recording information signal without biasing the droplets of the ink composition (electrostatic attraction method); a method forcibly ejecting the droplets of the ink composition by applying pressure to the ink composition with a small pump and mechanically vibrating the nozzle with a crystal oscillator or the like; a method (piezo method) ejecting the droplets of the ink composition and performing recording by adding pressure on the ink composition using a piezoelectric element at the same time as a recording information signal; a method (thermal jet method) ejecting the ink composition droplets and performing recording by heating and foaming the ink composition with a small electrode according to the recording information signal; and the like.

2.4. First Drying Means 40

The first drying means 40 dries the image 2. The first drying means 40 is not particularly limited as long as the configuration thereof allows the evaporation and dispersion of the liquid medium present in the ink composition to proceed. Examples thereof include means for applying heat to the recording medium, means for blowing a wind onto the image, means combining these, or the like. Specifically, forced air heating, radiant heating, conduction heating, high frequency drying, microwave drying, or the like is preferably used.

The ink jet recording apparatus 1000 according to the embodiment need not be provided with the first drying means 40 in a case where the above-described drying is not performed.

2.5. Second Hydrophilic Treatment Means

The second hydrophilic treatment means 120 can be configured using a known corona discharge treatment apparatus or a plasma discharge treatment apparatus. The hydrophilic treatment according to the second hydrophilic treatment means 120 is used in a case where the above-described second treatment step is performed. The ink jet recording apparatus 1000 according to the embodiment need not be provided with the second hydrophilic treatment means 120 in a case where the above-described second treatment step is not performed.

2.6. Second Recording Means

The second recording means 130 coats the image 2 recorded on the target recording face of the recording medium 1 using the coating liquid composition and forms a coating film. The second recording means 130 is provided with an ink jet recording head 131 provided with a nozzle ejecting the ink composition. Since the method of ejecting the coating liquid composition from the nozzle of the ink jet recording head 131 is similar to the example described in the first recording means 30, description thereof will be omitted.

In the ink jet recording apparatus 1000 according to the embodiment, a case where the second recording means 130 adopts an ink jet method from the viewpoint of being able to reduce the usage amount of the coating liquid composition has been illustrated; however, without being limited thereto, a coating method using a roll coater or the like may be adopted.

The ink jet recording apparatus 1000 according to the embodiment need not be provided with the second recording means 130 in a case where the above-described coating (condition (C)) is not performed.

2.7. Second Drying Means

The second drying means 140 dries the coating film formed of the coating liquid composition. Since the drying means which can be adopted as the second drying means 140 is similar to the example described in the first drying means 40, description thereof will be omitted.

The ink jet recording apparatus 1000 according to the embodiment need not be provided with the second drying means 140 in a case where the coating film formed of the above-described coating liquid composition is allowed to dry through natural drying.

3. Ink Composition

The ink composition used in the ink jet recording method according to the embodiment contains a coloring agent, resin, and water. Components included in the ink composition according to the embodiment are described in detail as follows.

3.1. Coloring Agent

The ink composition according to the embodiment contains a coloring agent. Examples of the coloring agents include dyes or pigments, and pigments are preferable from the viewpoints of water resistance, gas resistance, light resistance, and the like.

As the pigments, it is possible to use any of known inorganic pigments, organic pigments, or carbon black. The above pigments are preferably included in a range of 0.5 mass % or more to 20 mass % or less and more preferably included in a range of 1 mass % or more to 10 mass % or less, with respect to the total mass of the ink composition.

In order to apply the pigment to the ink composition, the pigment is preferably set so as to be able to be stably dispersed and held in water. Examples of the method include a method of dispersing in a resin dispersing agent of one or both of water-soluble resin and water-dispersible resin (below, pigments treated according to this method are described as "resin dispersed pigments"); a method of dispersing in a surfactant of one or both of a water-soluble surfactant and a water-dispersible surfactant (below, pigments treated according to this method are described as "surfactant dispersed pigments"); a method chemically and physically introducing a hydrophilic functional group into the pigment particle surface and capable of performing dispersing or dissolving in water without a dispersing agent (below, pigments treated according to this method are described as "surface treated pigments"); and the like. The ink composition according to the embodiment can use any of the resin dispersed pigment, the surfactant dispersed pigment, and the surface treated pigment, and these can be used in the form of a plurality of types mixed together according to necessity; however, it is preferable that the resin dispersing agent be contained.

Examples of the resin dispersing agent used in the resin dispersing pigment include polyvinyl alcohols, polyacrylic acid, acrylic acid-acrylonitrile copolymers, vinyl acetate-acrylic acid ester copolymers, acrylic acid-acrylic acid ester copolymers, styrene-acrylic acid copolymers, styrene-methacrylic acid copolymers, styrene-methacrylic acid-acrylic acid ester copolymers, styrene-α-methylstyrene acrylic acid copolymers, styrene-α-methylstyrene acrylic acid-acrylic acid ester copolymers, styrene-maleic acid copolymers, styrene-maleic anhydride copolymers, vinyl naphthalene-acrylic acid copolymers, vinyl naphthalene-maleic acid copolymers, vinyl acetate-maleic acid ester copolymers, vinyl acetate-crotonic acid copolymers, vinyl acetate-acrylic acid copolymers, and salts thereof. Among these, a copolymer of a monomer having a hydrophobic functional group and a monomer having a hydrophilic functional group, and a polymer formed of monomers having both a hydrophobic functional group and a hydrophilic functional group is preferable. As the form of the copolymer, any form of a random copolymer, a block copolymer, an alternating copolymer, and a graft copolymer can be used.

The salts include salts with basic compounds such as ammonia, ethylamine, diethylamine, triethylamine, propylamine, isopropylamine, dipropylamine, butylamine, isobutylamine, diethanolamine, triethanolamine, triisopropanolamine, amino methyl propanol, and morpholine. The addition amount of these basic compounds is not particularly limited as long as it is at least 50% with respect to the neutralization equivalent of the resin dispersing agent.

The molecular weight of the resin dispersing agent is preferably in the range of 1,000 to 100,000 as the weight average molecular weight, and more preferably in the range of 3,000 to 10,000. By the molecular weight being in the above range, the pigment is stably dispersed in water, and furthermore viscosity control and the like are easy during application to the ink composition.

In addition, the acid value is preferably in the range of 30 to 300, and more preferably in the range of 50 to 150. By the acid value being in the above range, it is possible to stably secure the dispersibility of the pigment particles in water.

Commercial products can also be used as the resin dispersing agent. Specifically, examples thereof include JONCRYL 67 (weight average molecular weight: 12,500, acid value: 213), JONCRYL 678 (weight average molecular weight: 8,500, acid value: 215), JONCRYL 586 (weight average molecular weight: 4,600, acid value: 108), JONCRYL 611 (weight average molecular weight: 8,100, acid value: 53) JONCRYL 680 (weight average molecular weight: 4,900, acid value: 215), JONCRYL 682 (weight average molecular weight: 1,700, acid value: 238), JONCRYL 683 (weight average molecular weight: 8,000, acid value: 160), JONCRYL 690 (weight average molecular weight: 16,500, acid value: 240) (the above are commercial products manufactured by BASF Japan Ltd.), and the like.

In addition, examples of the surfactant used in the surfactant dispersed pigment include alkane sulfonic acid salts, α-olefin sulfonic acid salts, alkyl benzene sulfonate, alkyl naphthalene sulfonate, acyl methyltaurine acid salts, dialkyl sulfo succinate, alkyl sulfate ester salts, olefin sulfate, polyoxyethylene alkyl ether sulfate ester salts, alkyl phosphate ester salts, polyoxyethylene alkyl ether phosphate ester salts, anionic surfactants such as monoglycidyl celite phosphoric acid ester salts, alkyl pyridinium salts, alkyl amino acid salts, amphoteric surfactants such as alkyl dimethyl betaine, polyoxyethylene alkyl ethers, polyoxyethylene alkyl phenyl ether, polyoxyethylene alkyl esters, polyoxyethylene alkyl amide, glycerin alkyl esters, and non-ionic surfactants such as sorbitan alkyl esters.

The addition amount with respect to the pigment of the resin dispersed agent or the surfactant is preferably 1 part by mass or more to 100 parts by mass or less with respect to 100 parts by mass of pigment, and more preferably 5 parts by mass or more to 50 parts by mass or less. By being in this range, the dispersion stability of the pigment in water is further improved.

As the method of dispersing the above-mentioned resin dispersed pigment, surfactant dispersed pigment, and surface treated pigment in water, it is possible to add pigment, water, and the resin dispersing agent for the resin dispersed pigment; pigment, water, and a surfactant for the surfactant dispersed pigment; the surface treated pigment and water for the surface treated pigment; as well as a water-soluble organic solvent, neutralizing agent, and the like as respectively necessary, and perform dispersion in a conventionally used dispersing machine such as a ball mill, a sand mill, an attritor, a roll mill, an agitator mill, a Henschel mixer, a colloid mill, an ultrasonic homogenizer, a jet mill, an ang mill, or the like. In such a case, as the particle diameter of the pigment, dispersion until the average particle diameter reaches 20 nm or more to 500 nm or less, more preferably 50 nm or more to 180 nm or less is preferable in terms of securing the dispersion stability of the pigment in the water.

3.2. Resin

The ink composition according to the embodiment contains a resin. The resin has an effect of solidifying the ink composition, and of further firmly fixing the solidified matter to the target recording face including a polyolefin. In this manner, it is possible to form an image with an excellent fixing property on the recording medium.

These resins are not particularly limited as long as the above-described effect is provided; however, examples thereof include (a) a resin including a (meth)acrylic acid based copolymer, (b) a resin including a copolymer of an olefin based monomer and a monomer having an aprotic polar group, (c) a resin including a copolymer of an olefin based monomer and a monomer containing halogen, and (d) a resin including a polycondensate of polycarboxylic acids and polyhydric alcohols. These resins may be used alone as one type or two or more may be used in combination.

The (a) resin including a (meth)acrylic acid based copolymer refers to a resin using at least one of (meth)acrylic acid and (meth)acrylic ester in a monomer component in order to obtain a polymer, and including at least a copolymer with another monomer component. The other monomer component is not particularly limited; however, examples thereof include styrene monomers. Examples of the (meth)acrylic acid copolymers include, specifically, styrene-(meth)acrylic acid copolymers, styrene-(meth)acrylic acid-(meth)acrylic acid ester copolymers, styrene-α-methylstyrene-(meth) acrylic acid copolymers, styrene-α-methylstyrene-(meth) acrylic acid-(meth)acrylic acid ester copolymers, and the like. Here, as the form of the copolymer, any form of a random copolymer, a block copolymer, an alternating copolymer, and a graft copolymer can be used. Here, as the (meth)acrylic acid based copolymer, a commercially available product may be used, with examples thereof including JONCRYL 352J (manufactured by BASF Japan Ltd., styrene-acrylic acid copolymer), or the like. In the invention, "(meth)acrylic acid based" signifies at least one among acrylic acid, methacrylic acid, acrylic acid esters and methacrylic acid esters.

In the (b) resin including a copolymer of an olefin based monomer and a monomer having an aprotic polar group, examples of the olefin based monomer include ethylene, propylene, butylene, and the like. In addition, examples of the monomer having an aprotic polar group include carboxylic acid esters, phosphate ester, vinyl esters, and the like, more specifically, examples of the carboxylic acid esters include acrylic acid esters (for example, methyl acrylate, ethyl acrylate, butyl acrylate, isopropyl acrylate, 2-ethylhexyl acrylate, and the like), methacrylic acid esters (for example, methyl methacrylate, ethyl methacrylate, butyl methacrylate, lauryl methacrylate, stearyl methacrylate, 2-ethylhexyl methacrylate, allyl methacrylate, cyclohexyl methacrylate, dodecyl penta decyl methacrylate, benzyl methacrylate, 2-methoxyethyl methacrylate, tetrahydrofurfuryl methacrylate, and the like), and as vinyl esters, specifically, vinyl acetate, vinyl propionate, vinyl stearate, vinyl pivalate, vinyl laurate, vinyl versatate, and the like. Among these, examples having excellent compatibility with the target recording face including polyolefin in the ink jet recording method of the embodiment (that is, having a hydrophobic portion in the polymer molecule structure), and examples further combining this with a hydrophilic portion having a strong adhesion are preferable, and, as such examples, ethylene vinyl ester copolymers (in particular, ethylene acetic acid vinyl copolymers) are preferable. Here, as the form of the copolymer, any form of a random copolymer, a block copolymer, an alternating copolymer, and a graft copolymer can be used.

As the (b) resin including a copolymer of an olefin based monomer and a monomer having an aprotic polar group, it is possible to use ones obtained by known materials and methods. In addition, it is possible to use commercially available products, examples of which include Denka EVA Tex 50, 55N, 59, 60, 65, 70, 75, 80, 81, 82, 88, 90, 100, 170 (the above are trade names manufactured by Denki Kagaku Kogyo Co., Ltd.), Sumikaflex 201HQ, 305HQ, 355HQ, 400HQ, 401HQ, 408HQ, 410HQ, 450HQ, 455HQ, 456HQ, 460HQ, 465HQ, 467HQ, 470HQ, 510HQ, 520HQ, 752, 755, 850HQ, 900HL, 950HQ, 951HQ, 7400HQ (the above are trade names manufactured by Sumitomo Chemical Co., Ltd.), CHEMIPEARL V100, V200, V300, EV210H (the above are trade names manufactured by Mitsui Chemicals, Inc.), VINYBLAN 3302, 1570, 1570J, 1570K, 1570L, 1540K, 1540L, A20J2, A23J1, A23J2, A34G2, A68J1, 4495LL, A23P2E, A68J1N, A70J9, B90J9, TLE-383, 4018, A22J7-F2, A22J8, 1157, 1502B revised, 1588C, 1588CL, 1588C revised, 1588FD, 1080, 1087, 1090B, 1571, A22J7-F2, 4470, 4485LL, 4495LL, 1042F, 1008, GV-6170, GV-6181, 1002, 1017-AD, KM-01, 1225, 1245L (the above are trade names manufactured by Nissin Chemical Industry Co., Ltd.), and the like. In particular, a resin formed from an emulsioned ethylene acetic acid vinyl copolymer by mixing 8 mass % to 35 mass % of an ethylene monomer into acetic acid vinyl monomer and performing emulsion polymerization under high pressure has excellent water resistance, weather resistance, and alkali resistance, and improves the fixing property with respect to the target recording face including polyolefin. The resin formed from the above-described ethylene acetic acid vinyl copolymer preferably has an acetic acid vinyl monomer content of 8 mass % to 35 mass %, and more preferably 12 mass % to 30 mass % from the aspects of the fixing property with the target recording face including polyolefin, the abrasion resistance, the water resistance, and the like.

In the (c) resin including a copolymer of an olefin based monomer and a monomer containing halogen, examples of the olefin based monomer specifically include ethylene, propylene, butylene, and the like. In addition, examples of the monomer containing halogen include vinyl halides and the like, specifically, vinyl chloride, vinyl bromide, vinyl fluoride, vinyl iodide, and the like. Among these, examples having good compatibility with respect to the target recording face including polyolefin in the ink jet recording method of the embodiment, and further combining this with a portion having a strong adhesion are preferable, and, as such examples, ones including ethylene halogenated vinyl copolymers (in particular, ethylene chloride vinyl copolymers) are preferable. Here, as the form of the copolymer, any form of a random copolymer, a block copolymer, an alternating copolymer, and a graft copolymer can be used.

As the (c) resin including a copolymer of an olefin based monomer and a monomer containing halogen, it is possible to use ones obtained by known materials and methods. In addition, it is also possible to use commercially available products, and examples of the resin including a copolymer of an olefin based monomer and a monomer containing halogen include VINYBLAN 271, 278, 472H, 690, 700, 701, 701J10, 701J30, 701J50, 701W5, 701W50, 701WP5, 701WP10, W, 701W50C, 701CL50, 701SF50, 701SFP50, 701SFP50-2, 701SFP50-2C, 701SF100, 701SF100C, 701CH50, 701CHP50, 701CHP50C, 701CHP50-2, 701CHP50-2C, 701CH100, 701CH100C, 902, SS-157, (the above are trade names manufactured by Nissin Chemical Industry Co., Ltd.), Sumi Elite 1010, 1320 (the above are trade names manufactured by Sumitomo Chemical Co., Ltd.), and the like.

In the (d) resin including a polycondensate of polycarboxylic acids and polyhydric alcohols, examples of the polycarboxylic acids specifically include oxalic acid succinic acid, tartaric acid, malic acid, citric acid, phthalic acid, isophthalic acid, terephthalic acid, 2,6-naphthalene dicarboxylic acid, adipic acid, and the like. In addition, examples of the polyalcohols specifically include ethylene glycol, 1,3-propanediol, 1,4-butanediol, 1,4-cyclohexanedimethanol, trimethylol propane, pentaerythritol and the like.

As the (d) resin including a polycondensate of polycarboxylic acids and polyhydric alcohols, it is possible to use ones obtained by known materials and methods. In addition, it is also possible to use commercially available products and examples thereof include Eastek 1100, 1300, 1400 (the above are trade names manufactured by Eastman Chemical Company, Japan), Elitel KA-5034, KA-3556, KA-1449, KT-8803, KA-5071S, KZA-1449S, KT-8701, KT 9204, (the above are trade names manufactured by Unitika Ltd.) and the like.

The resins of (a) to (d) described above may be polymerized using the following monomer components in addition to the monomer components illustrated in the description of each resin. Examples of such monomer components include acrylic acid esters (for example, methyl acrylate, ethyl acrylate, butyl acrylate, isopropyl acrylate, 2-ethylhexyl acrylate, and the like), carboxylic acid esters of methacrylic acid esters (for example, methyl methacrylate, ethyl methacrylate, butyl methacrylate, lauryl methacrylate, stearyl methacrylate, 2-ethylhexyl methacrylate, allyl methacrylate, cyclohexyl methacrylate, dodecyl penta decyl methacrylate, benzyl methacrylate, 2-methoxyethyl methacrylate, tetrahydrofurfuryl methacrylate, and the like), vinyl esters such as vinyl acetate, vinyl propionate, vinyl stearate, vinyl pivalate, vinyl laurate, and vinyl versatate, phosphoric acid esters, and the like.

The resin included in the ink composition according to the embodiment is preferably contained in the ink composition with the resin which is set as the main component in a fine particle state (commonly called an emulsion or suspension form). By containing the resin particles in the fine particle state, the viscosity of the ink composition is easily adjusted in an appropriate range in the ink jet recording method, and it is easy to secure storage stability and ejection stability.

The content of the resin is preferably in the range of 0.5 mass % or more to 5 mass % or less by solid content conversion with respect to the total mass of the ink composition. When the content of the resin is within the above-described range, in the target recording face including polyolefin, the effects of solidifying and fixing the ink composition become favorable. In addition, by being combined with drying to be described later, the effects of solidifying and fixing the ink composition can be further improved.

3.3. Water

The ink composition according to the embodiment contains water. The water is the main medium of the ink composition and is a component to be evaporated and dispersed by drying. The water is preferably one for which ionic impurities have been removed such as pure water or ultrapure water, such as ion-exchanged water, ultrafiltration water, reverse osmosis water, and distilled water. In addition, when water, which has been sterilized by ultraviolet irradiation, the addition of hydrogen peroxide, or the like, is used, it is possible to favorably prevent the occurrence of molds or bacteria in a case where a pigment dispersion and an ink composition using the same are stored for a long time.

The ink composition according to the embodiment may also be a so-called water-based ink including water as a main solvent (containing 50 mass % or more of water). The water-based ink also suppresses odor, and has the advantage of being environmentally friendly as a result of the 50 mass % or more of the components being water.

3.4. Glycol Ethers

The ink composition according to the embodiment may contain glycol ethers of which the HLB value calculated by the Davis method is 4.2 or more to 9.0 or less. The glycol ethers of which the above-mentioned HLB value range is satisfied can improve the wetting and spreading of the ink composition with respect to the target recording face including polyolefin and can improve the fixing property of the ink composition with respect to the target recording face. In addition, when the ink composition according to the embodiment contains glycol ethers satisfying the above-mentioned HLB value range, it is possible to record a clear image with less uneven shading with respect to the target recording face including polyolefin.

Here, the HLB value of the glycol ethers used in the embodiment refers to a value calculated according to the following formula (1) using a numerical value determined by the Davis method defined in, for example, the literature "J. T. Davies and E. K. Rideal", "Interface Phenomena" 2nd Ed. Academic Press, New York 1963" which is a value to evaluate the hydrophilicity of the compounds proposed by Davis et al.

$$\text{HLB value}=7+\Sigma[1]+\Sigma[2] \quad (1)$$

Wherein, [1] represents the base number of the hydrophilic groups, [2] represents the base number of the hydrophobic groups.

In the following Table 1, the base numbers of representative hydrophilic groups and hydrophobic groups are illustrated.

TABLE 1

| Structure | Base Number |
|---|---|
| $-CH_2-$ | −0.475 |
| $-CH_3$ | −0.475 |
| $-(CH_2CH_2O)-$ | +0.330 |
| $-(CH(CH_3)CH_2O)-$ | −0.150 |
| $-OH$ | +1.900 |

The glycol ethers included in the ink composition according to the embodiment have an HLB value calculated by the Davis method of 4.2 or more to 9.0 or less, and 5.4 or more to 8.5 or less is preferable. By the HLB value being within the above-described range and not particularly exceeding the lower limit thereof, the solubility of the glycol ethers with respect to water included as the main solvent of the ink composition is favorable, it is possible to add only enough to achieve the desired characteristics and the storage stability of the ink composition is favorable. In addition, by the HLB value being within the above-described range and not particularly exceeding the upper limit thereof, the wetting and spreading property with respect to the target recording face including polyolefin is favorable and a favorable image is obtained with less uneven shading while having an excellent fixing property.

Specific examples of such glycol ethers include ethylene glycol mono-isobutyl ether, ethylene glycol mono-hexyl ether, ethylene glycol mono-iso-hexyl ether, diethylene glycol mono-hexyl ether, triethylene glycol mono-hexyl ether, diethylene glycol mono-iso-hexyl ether, triethylene glycol mono-iso-hexyl ether, ethylene glycol mono-iso-heptyl ether, diethylene glycol mono-iso-heptyl ether, triethylene glycol mono-iso-heptyl ether, ethylene glycol mono-octyl ether, ethylene glycol mono-iso-octyl ether, diethylene glycol mono-iso-octyl ether, triethylene glycol mono-iso-octyl ether, ethylene glycol mono-2-ethylhexyl ether, diethylene glycol mono-2-ethylhexyl ether, triethylene glycol mono-2-ethylhexyl ether, diethylene glycol mono-2-ethyl pentyl ether, ethylene glycol mono-2-ethyl pentyl ether, ethylene glycol mono-2-methyl-pentyl ether, diethylene glycol mono-2-methyl pentyl ether, propylene glycol monobutyl ether, dipropylene glycol monobutyl ether, tripropylene glycol monobutyl ether, propylene glycol mono-propyl ether, dipropylene glycol mono-propyl ether, tripropylene glycol monomethyl ether, and the like. These can be used alone as one type or as a mixture of two or more types.

Among the illustrated glycol ethers, the alkyl group included in the glycol ethers more preferably has a branched structure. By containing the glycol ethers of which the alkyl group has a branched structure, it is possible to record clear images with less uneven shading with respect to the target recording face including polyolefin. Specifically, examples thereof include ethylene glycol mono-isobutyl ether, ethylene glycol mono-iso-hexyl ether, diethylene glycol mono-iso-hexyl ether, triethylene glycol mono-iso-hexyl ether, ethylene glycol mono-iso-heptyl ether, diethylene glycol mono-iso-heptyl ether, triethylene glycol mono-iso-heptyl ether, ethylene glycol mono-iso-octyl ether, diethylene glycol mono-iso-octyl ether, triethylene glycol mono-iso-octyl ether, ethylene glycol mono-2-ethylhexyl ether, diethylene glycol mono-2-ethylhexyl ether, triethylene glycol mono-2-ethylhexyl ether, diethylene glycol mono-2-ethylpentyl ether, ethylene glycol mono-2-ethylpentyl ether, ethylene glycol mono-2-methylpentyl ether, diethylene glycol mono-2-methylpentyl ether, and the like.

Even in the branched structure of the alkyl group included in the glycol ethers, from the viewpoint of further increasing the color development property of the ink composition, a 2-methylpentyl group, a 2-ethylpentyl group, and a 2-ethylhexyl group are more preferable, and a 2-ethylhexyl group is particularly preferable. Specifically, examples thereof include ethylene glycol mono-2-ethylhexyl ether, diethylene glycol mono-2-ethylhexyl ether, triethylene glycol mono-2-ethylhexyl ether, diethylene glycol mono-2-ethylpentyl ether, ethylene glycol mono-2-ethylpentyl ether, ethylene glycol mono-2-methylpentyl ether, diethylene glycol mono-2-methyl pentyl ether, and the like, and ethylene glycol mono-2-ethylhexyl ether, diethylene glycol mono-2-ethylhexyl ether, triethylene glycol mono-2-ethylhexyl ether, and the like are particularly preferable.

The content of the glycol ethers is preferably 0.05 mass % or more to 6 mass % or less with respect to the total mass of the ink composition from the viewpoints of the effects of improving the wetting and spreading property on the recording medium and reducing the uneven shading and securing the storage stability and ejection reliability of the ink composition. By the content of the glycol ethers being within the above-described range and not particularly exceeding the lower limit thereof, the wetting and spreading property and the drying property of the ink composition is favorable, and an image provided with a favorable recording image density (color development property) is obtained. In addition, by the content of the glycol ethers being within the above-described range and not particularly exceeding the upper limit thereof, it is possible to set the viscosity of the ink composition appropriately.

3.5 Other Components

The ink composition according to the embodiment can further contain wax, alkyl polyols, pyrrolidones, surfactants, pH adjusting agents, fungicides or preservatives, rust inhibitors, chelating agents and the like. If the ink composition according to the embodiment includes these compounds, its characteristics may be further improved in some cases.

3.5.1 Wax

The ink composition according to the embodiment may also contain wax. The wax imparts lubrication to the surface of the recorded image. In this manner, since it is possible to suppress the generation of peeling and rubbing of the image, the fixing property of the image is improved. In particular, in the ink composition according to the embodiment, when the above-described resin and wax are added in combination, the function provided by the resin of fixing the ink composition to the target recording face including polyolefin and the function provided by the wax of imparting lubrication to the recorded image surface act synergistically, and it is possible to remarkably improve the fixing property of the image.

As the components configuring the wax, for example, plant and animal waxes such as carnauba wax, candle wax, beeswax, rice wax, and lanolin; petroleum based waxes such as paraffin wax, microcrystalline wax, polyethylene wax, oxidized polyethylene wax, and petrolatum; mineral waxes such as montan wax, and ozokerite; synthetic waxes such as carbon wax, Hoechst wax, polyolefin wax, and stearic acid amide; natural or synthetic wax emulsions or mixed waxes such as α-olefin maleic anhydride copolymer or the like, and these can be used alone or a plurality of types can be mixed and used. Among these, from the viewpoint of a superior effect of increasing the fixing property with respect to the target recording face including polyolefin, the use of polyolefin wax (in particular, polyethylene wax, polypropylene wax) and paraffin wax is preferable.

It is possible to use a commercially available product as is as the wax, and examples thereof include Nopukoto PEM-17 (trade name, manufactured by San Nopco Co., Ltd.), CHEMIPEARL W4005 (trade name, manufactured by Mitsui Chemicals, Inc.), AQUACER 515, AQUACER 539, AQUACER 593 (the above are trade names manufactured by BYK-Japan), and the like.

The content of the wax is preferably in the range of 0.1 mass % or more to 5 mass % or less by solid content conversion with respect to the total mass of the ink composition. By the content of the wax being within the above-described range, it is possible to solidify and fix the ink composition to the target recording face including polyolefin using the synergistic effect with the resins described above, which is preferable.

3.5.2. Alkyl Polyols

The ink composition according to the embodiment may contain alkyl polyols of which the normal boiling point is 180° C. or more and 230° C. or less. As a result of the ink composition according to the embodiment containing alkyl polyols of which the boiling point is within the above-described range, there are cases where the control of the wetting and spreading property and the drying property becomes even easier. In this manner, it is possible to record an image having an excellent image quality and fixing property with respect to the target recording face including polyolefin, and it is possible to reduce the clogging of the nozzles, which is preferable.

The alkyl polyols have a normal boiling point which is 180° C. or more and 230° C. or less and 188° C. or more and 230° C. or less is preferable. By the normal boiling point of the alkyl polyols being within the above-described range and not particularly exceeding the lower limit thereof, the moisture retaining property of the ink composition is favorable and the suppression of the generation of nozzle clogging is easier, which is preferable. By the normal boiling point of the alkyl polyols being within the above-described range and not particularly exceeding the upper limit thereof, it is possible to suppress the generation of uneven shading in the image and the deterioration of the fixing property without greatly deteriorating the drying property of the ink composition, which is preferable.

Examples of the alkyl polyols of which the normal boiling point is 180° C. or more and 230° C. or less include propylene glycol [188° C.], dipropylene glycol [230° C.], 1,2-butanediol [194° C.], 1,2-pentanediol [210° C.], 1,2-hexanediol [224° C.], 1,2-heptanediol [227° C.], 3-methyl-1,3-butanediol [203° C.], 2-ethyl-2-methyl-1,3-propanediol [226° C.], 2-methyl-1,3-propanediol [214° C.], 2-methyl-2-propyl-1,3-propanediol [230° C.], 2,2-dimethyl-1,3-propanediol [210° C.], 2-methyl-2,4-diol [197° C.], and the like. Here, the numerical values in parentheses represent the normal boiling point.

Alkyl polyols of which the normal boiling point is 180° C. or more to 230° C. or less may be used alone as a single type, or two or more types may be mixed and used.

The content of the alkyl polyols is preferably 8 mass % or more to 25 mass % or less with respect to the total mass of the ink composition from the viewpoints of the effects of improving the wetting and spreading property on the recording medium and reducing the uneven shading and securing the storage stability and ejection reliability of the ink composition. By the normal boiling point of the alkyl polyols being within the above-described range and not particularly exceeding the lower limit thereof, the storage stability of the ink composition and the moisture retaining property of the ink composition are favorable and the suppression of the generation of nozzle clogging is easier, which is preferable. In addition, by the normal boiling point of the alkyl polyols being within the above-described range and not particularly exceeding the upper limit thereof, an image with a favorable fixing property and less uneven shading is obtained without greatly deteriorating the drying property of the ink composition, which is preferable.

The ink composition according to the embodiment preferably does not contain alkyl polyols of which the normal boiling point is 280° C. or more. By including alkyl polyols of which the normal boiling point is 280° C. or more, the drying property of the ink composition is significantly deteriorated. This is because, as a result, when recording is performed with respect to the target recording face including polyolefin, not only is the uneven shading of the image noticeable, but the fixing property of the image is also deteriorated in some cases. Examples of the alkyl polyols of which the normal boiling point is 280° C. or more include glycerin (normal boiling point 290° C.)

3.5.3. Pyrrolidones

Pyrrolidones can be used from the viewpoint of improving the fixing property of the ink composition. Examples of such pyrrolidones include N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, and the like.

3.5.4. Surfactant

The surfactant provides an effect of uniformly wetting and spreading the ink composition on the target recording medium. The surfactant is not particularly limited; however, it is preferably a non-ionic surfactant. Among non-ionic surfactants, one or both of silicone based surfactants and acetylene glycol-based surfactants are more preferable. A case where silicone surfactants and acetylene glycol-based surfactants are combined is even more preferable.

A polysiloxane based compound is preferably used as the silicone based surfactant and examples thereof include polyether-modified organosiloxane. In more detail, examples thereof include BYK-306, BYK-307, BYK-333, BYK-341, BYK-345, BYK-346, BYK-347, BYK-348 (the above are trade names manufactured by BYK-Chemie Japan Co., Ltd.), KF-351A, KF-352A, KF-353, KF-354L, KF-355A, KF-615A, KF-945, KF-640, KF-642, KF-643, KF-6020, X-22-4515, KF-6011, KF-6012, KF-6015, KF-6017, Trade names (the above are trade names manufactured by Shin-Etsu Chemical Co., Ltd.) and the like.

In comparison with other non-ionic based surfactants, the acetylene glycol-based surfactants have an excellent ability to appropriately maintain the surface tension and interfacial tension, and have the characteristic that there is almost no foaming. In this manner, since the ink composition containing the acetylene glycol-based surfactant can appropriately maintain the surface tension and the interfacial tension between the printer member coming into contact with the ink composition of the head nozzle face or the like, it is possible to increase the ejection stability when the above is applied to the ink jet recording method. Examples of the acetylene glycol-based surfactant include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (the above are all trade names produced by Air Products and Chemicals. Inc.), Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14, AE-3, (the above are all trade names produced by Nissin Chemical Industry Co., Ltd.), Acetylenol E00, E00P, E40, E100, (the above are all trade names produced by Kawaken Fine Chemicals Co., Ltd.), and the like.

3.5.5. Other

Examples of the pH adjusting agent include potassium dihydrogen phosphate, disodium hydrogen phosphate, sodium hydroxide, lithium hydroxide, potassium hydroxide, ammonia, diethanolamine, triethanolamine, triisopropanolamine, potassium carbonate, sodium carbonate, sodium hydrogen carbonate and the like.

Examples of the preservatives and fungicides include sodium benzoate, pentachlorophenol sodium, 2-pyridine thiol-1-sodium oxide, sodium sorbate, sodium dehydroacetic acid, 1,2-dibenzisothiazoline-3-one, and the like. Examples of commercially available products include Proxel XL2, Proxel GXL, (the above are trade names produced by Avecia Co., Ltd.), or Denicide CSA, NS-500 W (the above are trade names produced by Nagase Chemtex Co., Ltd.).

Examples of the rust inhibitor include benzotriazole and the like.

Examples of the chelating agent include ethylenediaminetetraacetic acid and salts thereof (such as ethylenediaminetetraacetic acid disodium dihydrogen salt), iminodisuccinic acid and salts thereof, and the like.

3.6. Preparation Method of Ink Composition

The ink composition according to the embodiment is obtained by mixing the above-mentioned components in an arbitrary order, performing filtration or the like according to necessity, and removing impurities. As the method of mixing each component, a method of sequentially adding material to a container provided with a stirring apparatus such as a mechanical stirrer or a magnetic stirrer and then stirring and mixing may be favorably used. As the method of filtration, it is possible to perform centrifugal filtration, filtration using a filter, or the like according to necessity.

3.7. Physical Properties of Ink Composition

In the ink composition according to the embodiment, from a viewpoint of balance between the image quality and the reliability as an ink composition for an ink jet, the surface tension at 20° C. is preferably from 20 mN/m or more to 50 mN/m, and more preferably from 25 mN/m or more to 40 mN/m or less. Here, for example, the measurement of the surface tension can be measured by confirming the surface tension when a platinum plate is wetted with the ink composition in an environment of 20° C. using an Automatic Surface Tensiometer CBVP-Z (trade name, manufactured by Kyowa Interface Science Co., Ltd.).

In addition, from a similar viewpoint, the viscosity at 20° C. of the ink composition according to the embodiment is preferably from 2 mPa·s or more to 15 mPa·s or less and more preferably from 2 mPa·s or more to 10 mPa·s or less. Here, for measurement of viscosity, for example, the viscosity can be measured in an environment of 20° C. using a viscoelasticity tester MCR-300 (trade name, manufactured by Pysica Co., Ltd.).

4. Coating Liquid Composition

The ink jet recording method according to the embodiment can include, after the recording, coating the image with a coating liquid composition containing wax (condition (C)). The coating liquid composition according to the embodiment does not contain a coloring agent (for example, a pigment, a dye, or the like). Therefore, when the solvent component (water or the like) included in the coating liquid composition is evaporated and dispersed, a transparent or semi-transparent coating film (clear film) is formed.

When used to coat at least the image as described above, the coating liquid composition according to the embodiment may be attached to places where the image is not recorded in the target recording face.

Below, detailed description will be given of the components included in the coating liquid composition.

4.1. Wax

The ink composition according to the embodiment contains wax. As one function of the wax, imparting lubrication to the surface of the coating film formed of the coating liquid composition may be exemplified. In this manner, since it is possible to suppress the generation of peeling and rubbing of the coating film, the fixing property of the coating film is improved. As a result, the fixing property of the image formed by the ink composition coated by the coating film is improved. Since specific examples of the components configuring the wax are the same as the contents described in the above "3.5.1 Wax", description thereof will be omitted.

Among the components configuring the waxes illustrated in the above-described "3.5.1. Wax", from the viewpoint that the above-described functions are more favorable, polyolefin wax (in particular, polyethylene wax and polypropylene wax) and paraffin wax are preferably used, and paraffin wax is more preferably used.

The content of the wax included in the coating liquid composition according to the embodiment is preferably 10 mass % or more to 40 mass % or less, and more preferably 14 mass % or more to 30 mass % or less, based on the total mass of the coating liquid composition. When the content of the wax included in the coating liquid composition is within the above-described range, it is possible to sufficiently improve the fixing property of the image recorded on the target recording face.

4.2. Glycol Ethers

The coating liquid composition according to the embodiment may contain glycol ethers of which the HLB value calculated by the Davis method is 4.2 or more to 9.0 or less. The glycol ethers of which the above-mentioned HLB value range is satisfied can improve the wetting and spreading of the coating liquid composition with respect to the image and the target recording face including polyolefin and can improve the fixing property of the coating liquid composition. In this manner, it is possible to improve the fixing property of the image with respect to the target recording face including polyolefin.

Since specific examples of the above-described glycol ethers are the same as the contents described in "3.4. Glycol Ethers", description thereof will be omitted.

In a case where glycol ethers are contained in the coating liquid composition according to the embodiment, the content thereof with respect to the total mass of the coating liquid composition is preferably 0.05 mass % or more to 6 mass % or less. When the content of the above-described glycol ethers included in the coating liquid composition is within the above-described range, the wetting and spreading property and the fixing property of the coating liquid composition with respect to the image formed of the ink composition and the target recording face including polyolefin are improved. In addition, when the coating liquid composition is ejected using an ink jet recording head, it is possible to appropriately set the viscosity of the coating liquid composition.

4.3. Other Components

The coating liquid composition according to the embodiment may further contain alkyl polyols of which the normal boiling point is 180° C. or more and 230° C. or less. As a result of the coating liquid composition according to the embodiment containing alkyl polyols of which the boiling point is within the above-described range, the control of the wetting and spreading property and the drying property of the coating liquid composition becomes even easier. In this manner, it is possible to record an image having an excellent image quality and fixing property with respect to the image formed of the ink composition and the target recording face including polyolefin, and it is possible to reduce the clogging of the nozzles when the coating liquid composition is ejected from the ink jet recording apparatus. Since specific examples of the above-described alkyl polyols are the same as the above-described "3.5.2. Alkyl Polyols", description thereof will be omitted.

In a case where the above-described alkyl polyols are contained in the coating liquid composition according to the embodiment, the content thereof with respect to the total mass of the coating liquid composition is preferably 20 mass % or more to 40 mass % or less, and more preferably 25 mass % or more to 35 mass % or less. By the content of the above-described alkyl polyols included in the coating liquid composition being within the above-described range, the storage stability of the coating liquid composition and the moisture retaining property of the ink composition are favorable and it is possible to reduce the generation of nozzle clogging when the ink jet recording apparatus is used.

Here, the coating liquid composition according to the embodiment preferably does not contain alkyl polyols of which the normal boiling point is 280° C. or more. By including alkyl polyols of which the normal boiling point is 280° C. or more, the drying property of the coating liquid composition is significantly deteriorated. This is because, as a result, when recording is performed with respect to the image formed of the ink composition and the target recording face including polyolefin, the fixing property of the image is deteriorated in some cases. Examples of the alkyl polyols of which the normal boiling point is 280° C. or more include glycerin (normal boiling point 290° C.)

The coating liquid composition according to the embodiment may contain components other than those described above with the object of further improving the characteristics thereof. Examples of such components include pyrrolidones, surfactants, pH adjusting agents, fungicides and preservatives, rust inhibitors, chelating agents, and the like. Since specific examples of these components are the same as those exemplified in the ink composition, description thereof will be omitted.

4.4. Preparation Method of Coating Liquid Composition

The coating liquid composition according to the embodiment is obtained by mixing the above-mentioned components in an arbitrary order, performing filtration or the like according to necessity, and removing impurities. As the method of mixing each component, a method of sequentially adding material to a container provided with a stirring apparatus such as a mechanical stirrer or a magnetic stirrer and then stirring and mixing may be favorably used. As the method of filtration, it is possible to perform centrifugal filtration, filtration using a filter, or the like according to necessity.

4.5. Physical Properties of Coating Liquid Composition

In a case where the coating liquid composition according to the embodiment is ejected from a nozzle of an ink jet recording head, from a viewpoint of balance between the image quality and the reliability for an ink jet, the surface tension at 20° C. is preferably from 20 mN/m or more to 50 mN/m, and more preferably from 25 mN/m or more to 40 mN/m or less. Here, for example, the measurement of the surface tension can be measured by confirming the surface tension when a platinum plate is wetted with the configuration in an environment of 20° C. using an Automatic Surface Tensiometer CBVP-Z (manufactured by Kyowa Interface Science Co., Ltd.).

In addition, from a similar viewpoint, the viscosity at 20° C. of the coating liquid composition according to the embodiment is preferably from 2 mPa·s or more to 15 mPa·s or less and more preferably from 2 mPa·s or more to 10 mPa·s or less. Here, for measurement of viscosity, for example, the viscosity can be measured in an environment of 20° C. using a viscoelasticity tester MCR-300 (trade name, manufactured by Pysica Co., Ltd.).

5. Examples

Below, further specific description will be given of an embodiment according to an aspect of the invention using Examples; however, the embodiment is not limited only to these examples.

5.1. Preparation of Ink Composition 5.1.1. Preparation of Pigment Dispersion

The ink composition used in the Examples used a water-insoluble pigment as a coloring agent. When the pigment was added to the ink composition, a resin dispersed pigment in which the pigment was dispersed in advance using a resin dispersing agent was used.

The pigment dispersion was prepared as follows. First, 7.5 parts by mass of an acrylic acid-acrylic acid ester copolymer (weight average molecular weight: 25,000, acid value: 180) as a resin dispersing agent was added to and dissolved in 76 parts by mass of ion-exchanged water in which 1.5 parts by mass of a 30% aqueous ammonia solution (neutralizing agent) was dissolved. Here, 15 parts by mass of C.I. pigment black 7 were added as a pigment and a dispersion process was performed for 10 hours in a ball mill using zirconia beads. Thereafter, centrifugal filtration was performed using a centrifuge, impurities such as coarse particles and dust were removed, and the pigment concentration was adjusted to become 15 mass %.

5.1.2. Preparation of Ink Composition

Using the pigment dispersion prepared in the above-described "5.1.1. Preparation of Pigment Dispersion", black ink compositions 1 to 8 were obtained with the material compositions shown in Table 2. After placing the material shown in Table 2 in the container and stirring and mixing for two hours with a magnetic stirrer, each ink composition was prepared by removing the impurities such as dust and coarse particles by performing filtration with a membrane filter having a pore diameter of 5 μm. Here, the numerical values in Table 2 are all in mass % and ion-exchanged water was added so that the total masses of the ink compositions became 100 mass %.

5.2. Preparation of Coating Liquid Composition

With the material compositions shown in Table 2, coating liquid compositions (1) to (5) having different material compositions were obtained. After placing the material shown in Table 2 in the container and stirring and mixing for two hours with a magnetic stirrer, each coating liquid composition was prepared by removing the impurities such as dust and coarse particles by performing filtration with a membrane filter having a pore diameter of 5 μm. Here, the numerical values in Table 2 are all in mass % and ion-exchanged water was added so that the total masses of the coating liquid compositions became 100 mass %.

Here, in Table 2, the described materials other than the compound names are as follows.

JONCRYL 352J (trade name, manufactured by BASF Japan Ltd., styrene-acrylic acid copolymer emulsion)

Sumikaflex 752 (trade name, manufactured by Sumitomo Chemical Co., Ltd., ethylene-vinyl acrylic acid copolymer emulsion)

VINYBLAN 701CHP50C (trade name, manufactured by Nissin Chemical Industry Co., Ltd., vinyl chloride copolymer emulsion)

Elitel KT-8803 (trade name, manufactured by Unitika Ltd., ester-based emulsion)

AQUACER 515 (trade name, polyethylene wax emulsion, manufactured by BYK-Japan Co., Ltd.)

AQUACER 539 (trade name, paraffin wax emulsion, manufactured by BYK-Japan Co., Ltd.)

BYK-348 (trade name, manufactured by BYK-Japan Co., Ltd., silicone based surfactant)

Surfynol DF-110D (trade name, manufactured by Air Products and Chemicals. Inc., acetylene glycol-based surfactant)

TABLE 2

| | Ink Composition | | | | | | | | Coating Liquid Composition | | | | |
|---|---|---|---|---|---|---|---|---|---|---|---|---|---|
| Material | 1 | 2 | 3 | 4 | 5 | 6 | 7 | 8 | (1) | (2) | (3) | (4) | (5) |
| Pigment dispersion (pigment concentration: 15 mass %) | 30 | 30 | 30 | 30 | 30 | 30 | 30 | 30 | — | — | — | — | — |
| JONCRYL 352J (styrene-acrylic acid copolymer emulsion) <45% dispersion> (resin) | 2.22 | 2.22 | 2.22 | 2.22 | 2.22 | — | — | — | — | — | — | — | — |
| Sumikaflex 752 (ethylene-vinyl acrylic acid copolymer emulsion) <50% dispersion> (resin) | — | — | — | — | — | 2 | — | — | — | — | — | — | — |
| VINYBLAN 701CHP50C (vinyl chloride based emulsion) <30% dispersion> (resin) | — | — | — | — | — | — | 3.33 | — | — | — | — | — | — |
| Elitel KT-8803 (ester-based emulsion) <30% dispersion> (resin) | — | — | — | — | — | — | — | 3.33 | — | — | — | — | — |
| AQUACER 515 (polyethylene wax emulsion) <35% dispersion> (wax) | 2.86 | 2.86 | 2.86 | 2.86 | 2.86 | 2.86 | 2.86 | 2.86 | 14.29 | — | — | — | — |
| AQUACER 539 (paraffin wax emulsion) <35% dispersion> (wax) | — | — | — | — | — | — | — | — | — | 14.29 | 28.57 | 14.29 | 14.29 |
| Triethylene glycol monobutyl ether (glycol ether, HLB value: 8.5) | — | — | — | — | 5 | — | — | — | — | — | — | — | 5 |
| Tripropylene glycol mono methyl ether (glycol ether, HLB value: 8.0) | — | — | 5 | — | — | — | — | — | — | — | 5 | — | — |
| Ethylene glycol mono-2-ethylhexyl ether (glycol ether, HLB value: 5.4) | — | 1 | — | — | — | — | — | — | — | — | — | — | — |
| Diethylene glycol mono-2-ethyl hexyl ether (glycol ether, HLB value: 5.8) | 1 | — | — | — | — | 1 | 1 | 1 | 1 | 1 | — | — | — |
| 1,2-hexanediol (1,2-alkyl diols) | 5 | 5 | 5 | 8 | 5 | 5 | 5 | 5 | 5 | 5 | 5 | 8 | 5 |
| Propylene glycol (1,2-alkyl diols) | — | 15 | — | 15 | 15 | — | — | — | 25 | 25 | 20 | 25 | 20 |

TABLE 2-continued

| | Ink Composition | | | | | | | | Coating Liquid Composition | | | | |
|---|---|---|---|---|---|---|---|---|---|---|---|---|---|
| Material | 1 | 2 | 3 | 4 | 5 | 6 | 7 | 8 | (1) | (2) | (3) | (4) | (5) |
| 1,2-butane diol (1,2-alkyl diols) | 15 | — | — | — | — | 15 | 15 | 15 | — | — | — | — | — |
| 1,2-pentane diol (1,2-alkyl diols) | — | — | 15 | — | — | — | — | — | — | — | — | — | — |
| BYK-348 (silicone based surfactant) | 0.5 | 0.5 | 0.5 | 0.5 | 0.5 | 0.5 | 0.5 | 0.5 | 0.5 | 0.5 | 0.5 | 0.5 | 0.5 |
| Surfynol DF110D (acetylene glycol based surfactant) | 0.2 | 0.2 | 0.2 | 0.2 | 0.2 | 0.2 | 0.2 | 0.2 | 0.2 | 0.2 | 0.2 | 0.2 | 0.2 |
| Triethanolamine (pH adjusting agent) | 0.1 | 0.1 | 0.1 | 0.1 | 0.1 | 0.1 | 0.1 | 0.1 | 0.1 | 0.1 | 0.1 | 0.1 | 0.1 |
| Ethylenediamine tetraacetic acid (chelating agent) | 0.05 | 0.05 | 0.05 | 0.05 | 0.05 | 0.05 | 0.05 | 0.05 | 0.05 | 0.05 | 0.05 | 0.05 | 0.05 |
| Benzotriazole (rust inhibiting agent) | 0.02 | 0.02 | 0.02 | 0.02 | 0.02 | 0.02 | 0.02 | 0.02 | 0.02 | 0.02 | 0.02 | 0.02 | 0.02 |
| Ion-exchanged water | Remainder | Remainder | Remainder | Remainder | Remainder | Remainder | Remainder | Remainder | Remainder | Remainder | Remainder | Remainder | Remainder |

5.3. Evaluation of Recording Material 5.3.1. Uneven Shading Evaluation of Recording Material In Examples 1 to 8 and Reference Example 1 in Table 3, uneven shading evaluation of recording material was performed with and without hydrophilic treatment of the recording medium.

In Examples 1 to 8, a biaxially oriented polypropylene film (OPP, model number: FOR, thickness 20 μm, manufactured by Futamura Chemical Co., Ltd.) was used as the recording medium. In addition, in Reference Example 1, a PET film (trade name: PET50A, manufactured by PL Shin Lintec Corporation) was used as the recording medium.

In addition, as the printer of the ink jet recording method, the ink jet printer PX-G930 (trade name, manufactured by Seiko Epson Corporation, nozzle resolution: 180 dpi) to which a heater capable of changing the temperature in the paper guide inner portion was attached was used.

The ink jet printer PX-G930 was filled with the ink compositions 1 to 8 and recording was performed on the above-described recording media. As the recording pattern, a fill pattern was created, which was capable of being recorded in 10% increments at a resolution of 720 dpi horizontally and 720 dpi vertically and at a duty in the range of 50% to 100%, and this pattern was used.

In addition, as the recording conditions, the following conditions were combined and recording was performed. The heater setting of the printer during recording was set to "Set temperature of the recording face to 40° C.". Furthermore, a drying process was performed by blowing air at a temperature of 60° C. with respect to the recording material during recording and directly after recording. Here, the intensity of the above-described blowing indicates a state where wind is blown such that the wind speed on the recording medium surface became 2 m/s to 5 m/s. In addition, the blowing time directly after the recording was set to one minute.

In addition, the hydrophilic treatment on the recording medium was performed according to a corona discharge treatment using an internal corona discharge treatment machine according to conditions of input electrode: 90 W, electrode width: 0.2 m, irradiation speed: 1 m/min (that is, corona discharge amount: 450 W·min/m$^2$). Here, in a case where a hydrophilic treatment was performed on the recording medium, the hydrophilic treatment was performed before the ink composition was ejected.

The shading unevenness of the recording material when recording was performed under these conditions was visually confirmed. The results are shown in Table 3. In addition, the evaluation criteria of the shading unevenness of the recording material are as follows.

A: shading unevenness was not recognized even at a duty of 80% or more

B: shading unevenness was not recognized up to a duty of 70%

C: shading unevenness was not recognized up to a duty of 60%

D: shading unevenness was recognized even at a duty of 60% or less

TABLE 3

| | | Example 1 | Example 2 | Example 3 | Example 4 | Example 5 | Example 6 | Example 7 | Example 8 | Reference Example 1 |
|---|---|---|---|---|---|---|---|---|---|---|
| Used Ink Composition | | 1 | 2 | 3 | 4 | 5 | 6 | 7 | 8 | 4 |
| Recording conditions | Hydrophilic treatment - Yes | A | A | B | C | A | A | A | A | A |
| | Hydrophilic treatment - No | B | B | C | D | C | B | B | B | B |

5.3.2. Evaluation of Tape Peeling Property of Recording Material

In Examples 9 to 48 of Table 4, Examples 49 to 56 and Reference Example 2 of Table 5, evaluation of the tape peeling property of the recording material was performed.

In Examples 9 to 56, a biaxially oriented polypropylene film (OPP, model number: FOR, thickness 20 μm, manufactured by Futamura Chemical Co., Ltd.) was used as the recording medium. In addition, in Reference Example 2, a PET film (trade name: PET50A, manufactured by PL Shin Lintec Corporation) was used as the recording medium.

In addition, as the printer of the ink jet recording method, the printer used in the above-described "5.3.1. Uneven Shading Evaluation of Recording Material" was used. Here, this evaluation was performed in a laboratory at room temperature (25° C.).

The ink jet printer PX-G930 was filled with the ink compositions 1 to 8 and the coating liquid compositions (1) to (5) and recording was performed on the above-described recording media. As the recording pattern, a fill pattern was created, which was capable of being recorded at a resolution of 720 dpi horizontally and 720 dpi vertically and at a duty of 100%, and this pattern was used. The other recording conditions were set in the same manner as the above-described "5.3.1. Uneven Shading Evaluation of Recording Material".

Thereafter, the tape peeling property was evaluated by sticking a transparent adhesive tape (trade name: Transparent Color manufactured by Sumitomo 3M Ltd.) to a recording face of the recording material placed for 5 hours in the laboratory under conditions of room temperature (25° C.) and then confirming the peeling of the recording face and the transfer state to the tape when the tape is peeled off by hand. In addition, the evaluation criteria of the tape peeling property are as follows. In addition, the results are shown in Table 4.

Here, regarding the headings of "1+(1)" and the like of the "Used Ink Composition Set" in Table 4, the case of "1+(1)" signifies "recording in which the ink composition 1 and the coating liquid composition (1) are combined". In addition, the combined recording refers to recording in which, after the image is recorded using the ink composition, the coating liquid composition is attached thereon.

In addition, in Tables 4 and 5, "(before recording the ink composition)" indicates performing a hydrophilic treatment in the region to be recorded with the ink composition before the recording is performed using the ink composition. In addition, in Table 4, "(Before ink composition recording and before coating liquid composition recording)" refers to performing a hydrophilic treatment in a scheduled region to be recorded with the image before the recording is performed using the ink composition and performing the hydrophilic treatment with respect to the recorded image.

A: peeling of the recording face and transfer to the tape was not recognized

B: peeling of the recording face was not recognized, but transfer to the tape was slight recognized C: the recording face was partially peeled D: the recording face was entirely peeled

TABLE 4

| | | Example 9 | Example 10 | Example 11 | Example 12 | Example 13 | Example 14 | Example 15 | Example 16 |
|---|---|---|---|---|---|---|---|---|---|
| Set of Used Ink Composition | | 1 + (1) | 1 + (2) | 1 + (3) | 1 + (4) | 1 + (5) | 2 + (1) | 2 + (2) | 2 + (3) |
| Recording conditions | (I) Hydrophilic treatment - Yes (before recording ink composition) | B | A | A | B | A | B | A | A |
| | (II) Hydrophilic treatment - Yes (before recording ink composition + before recording coating liquid composition) | A | A | A | A | A | A | A | A |
| | (III) Hydrophilic treatment - No | B | B | B | B | B | B | B | B |

| | | Example 17 | Example 18 | Example 19 | Example 20 | Example 21 | Example 22 | Example 23 |
|---|---|---|---|---|---|---|---|---|
| Set of Used Ink Composition | | 2 + (4) | 2 + (5) | 3 + (1) | 3 + (2) | 3 + (3) | 3 + (4) | 3 + (5) |
| Recording conditions | (I) Hydrophilic treatment - Yes (before recording ink composition) | B | A | B | B | A | B | B |
| | (II) Hydrophilic treatment - Yes (before recording ink composition + before recording coating liquid composition) | B | A | B | A | A | B | A |
| | (III) Hydrophilic treatment - No | B | B | B | B | B | C | B |

| | | Example 24 | Example 25 | Example 26 | Example 27 | Example 28 | Example 29 | Example 30 | Example 31 | Example 32 | Example 33 |
|---|---|---|---|---|---|---|---|---|---|---|---|
| Set of Used Ink Composition | | 4 + (1) | 4 + (2) | 4 + (3) | 4 + (4) | 4 + (5) | 5 + (1) | 5 + (2) | 5 + (3) | 5 + (4) | 5 + (5) |
| Recording conditions | (I) Hydrophilic treatment - Yes (before recording ink composition) | C | C | C | C | C | C | C | C | C | C |

TABLE 4-continued

| | | | | | | | | | | |
|---|---|---|---|---|---|---|---|---|---|---|
| | (II) Hydrophilic treatment - Yes (before recording ink composition + before recording coating liquid composition) | B | B | B | B | B | B | B | B | B | B |
| | (III) Hydrophilic treatment - No | D | D | D | D | D | C | C | C | C | C |

| | | Example 34 | Example 35 | Example 36 | Example 37 | Example 38 | Example 39 | Example 40 | Example 41 |
|---|---|---|---|---|---|---|---|---|---|
| Set of Used Ink Composition | | 6 + (1) | 6 + (2) | 6 + (3) | 6 + (4) | 6 + (5) | 7 + (1) | 7 + (2) | 7 + (3) |
| Recording conditions | (I) Hydrophilic treatment - Yes (before recording ink composition) | A | A | A | B | A | B | A | A |
| | (II) Hydrophilic treatment - Yes (before recording ink composition + before recording coating liquid composition) | A | A | A | B | A | B | A | A |
| | (III) Hydrophilic treatment - No | B | B | B | B | B | B | B | B |

| | | | Example 42 | Example 43 | Example 44 | Example 45 | Example 46 | Example 47 | Example 48 |
|---|---|---|---|---|---|---|---|---|---|
| Set of Used Ink Composition | | | 7 + (4) | 7 + (5) | 8 + (1) | 8 + (2) | 8 + (3) | 8 + (4) | 8 + (5) |
| Recording conditions | (I) Hydrophilic treatment - Yes (before recording ink composition) | | B | A | B | A | A | B | A |
| | (II) Hydrophilic treatment - Yes (before recording ink composition + before recording coating liquid composition) | | B | A | B | A | A | B | A |
| | (III) Hydrophilic treatment - No | | C | B | B | B | B | C | B |

TABLE 5

| | | Example 49 | Example 50 | Example 51 | Example 52 | Example 53 | Example 54 | Example 55 | Example 56 | Reference Example 2 |
|---|---|---|---|---|---|---|---|---|---|---|
| Used Ink Composition | | 1 | 2 | 3 | 4 | 5 | 6 | 7 | 8 | 4 |
| Recording conditions | (IV) Hydrophilic treatment - No Coating Liquid Composition recording - No | D | D | D | D | D | C | D | D | B |
| Recording conditions | (V) Hydrophilic treatment - Yes (before recording ink composition) Coating Liquid Composition recording - No | B | B | B | D | C | B | B | B | — |

5.4 Evaluation Results

As the evaluation results of Table 3 to Table 5, it was shown that, in a case where an ink composition 4 was used, since the condition (B) shown in aspect 1 was not satisfied, if the condition (A) and the condition (C) shown in aspect 1 are not simultaneously satisfied, it is not possible to satisfy the shading unevenness (refer to Table 3) or the tape peeling property (refer to Tables 4 and 5) of the recording material.

In addition, it was shown that, in a case where only one among the condition (A), the condition (B), and the condition (C) shown in aspect 1 is not satisfied, in comparison with a case where two or more among the conditions (A) to (C) are satisfied at the same time, at least one among the shading unevenness evaluation (refer to Table 3) of the recording material or the tape peeling property evaluation (refer to Tables 4 and 5) of the recording material is deteriorated. Among these, in particular, with regard to a case where all three of the condition (A), the condition (B), and the condition (C) are satisfied, it was shown that all of the evaluation items were excellent.

Here, Reference Example 1 and Reference Example 2 do not satisfy any of the condition (A), the condition (B), and the condition (C) shown in aspect 1, or satisfy only the condition (A); however, both the shading unevenness evaluation (refer to Table 3) of the recording material or the tape peeling property evaluation (refer to Table 5) of the recording material showed favorable results. As the reason for obtaining such results, using the PET film as the recording medium may be exemplified.

The invention is not limited to the embodiments described above and various modifications are possible. For example, the invention includes configurations which are the substantially the same as the configurations described in the embodiments (for example, configurations having the same function, method and results, or configurations having the same purpose and effect). In addition, the invention includes configurations in which non-essential parts of the configurations described in the embodiments are replaced. In addition, the invention includes configurations exhibiting the same operation and effect as the configurations described in the embodiments or configurations capable of achieving the same object. In addition, the invention includes configurations in which known techniques were added to the configurations described in the embodiments.

What is claimed is:

1. An ink jet recording method comprising:

recording an image on a target recording face including polyolefin by ejecting an ink composition containing water, a coloring agent, and resin from nozzles of an ink jet recording head, wherein the following condition (A) is satisfied and one or both of condition (B) and condition (C) are satisfied, Condition (A): Prior to the recording, there is included performing a hydrophilic treatment on the target recording face such that the target recording face has a hydrophilic polar group, Condition (B): The ink composition includes glycol ethers of which an HLB value calculated by the Davis method is 4.2 or more to 9.0 or less, Condition (C): After the recording, there is included coating the image with a coating liquid composition containing wax.

2. The ink jet recording method according to claim 1, wherein:

the Condition (C) is satisfied, and the method further comprises performing a second hydrophilic treatment on the image before the coating in the condition (C).

3. The ink jet recording method according to claim 1, wherein the resin is at least one type or more selected from (a) a resin including a (meth)acrylic acid based copolymer, (b) a resin including a copolymer of an olefin based monomer and a monomer having an aprotic polar group, (c) a resin including a copolymer of an olefin based monomer and a monomer containing halogen, and (d) a resin including a polycondensate of polycarboxylic acids and polyhydric alcohols.

4. The ink jet recording method according to claim 1, wherein the wax in the condition (C) is a paraffin wax or a polyolefin wax.

5. The ink jet recording method according to claim 1, wherein the coating liquid composition in the condition (C) contains glycol ethers of which the HLB value calculated by the Davis method is 4.2 or more to 9.0 or less.

6. The ink jet recording method according to claim 1, wherein an alkyl group of the glycol ethers in the condition (B) has a branched structure.

7. The ink jet recording method according to claim 1, wherein the hydrophilic polar group is a carboxyl group or a hydroxyl group.

8. The ink jet recording method according to claim 1, wherein the hydrophilic treatment is performed using a corona discharge treatment apparatus or a plasma discharge treatment apparatus.

* * * * *